United States Patent [19]

Svoboda

[11] Patent Number: 4,494,398

[45] Date of Patent: Jan. 22, 1985

[54] TUBING EXPANDER APPARATUS

[75] Inventor: Edward J. Svoboda, Hinsdale, Ill.

[73] Assignee: Midas International Corporation, Chicago, Ill.

[21] Appl. No.: 465,916

[22] Filed: Feb. 14, 1983

[51] Int. Cl.[3] ..... B21D 39/08

[52] U.S. Cl. ..... 72/393; 72/453.16

[58] Field of Search ..... 72/392, 393, 453.16, 72/453.17; 60/468, 494; 92/130 R

[56] References Cited

U.S. PATENT DOCUMENTS

| | | | |
|---|---|---|---|
| 2,281,476 | 4/1942 | Casey | 92/130 R |
| 2,357,123 | 8/1944 | Maxwell | 72/393 |
| 2,390,537 | 12/1945 | Huck | 72/453.16 |
| 2,542,305 | 2/1951 | Brinen et al. | 72/393 |
| 2,870,743 | 1/1959 | Juilfs | 92/130 R |
| 2,925,253 | 2/1960 | Long | 60/468 |
| 3,385,087 | 5/1968 | Huth | 72/393 |
| 3,888,102 | 6/1975 | Nigido | 72/393 |
| 4,010,630 | 3/1977 | Davis, Jr. et al. | 72/453.17 |
| 4,198,844 | 4/1980 | Lowe et al. | 72/393 |
| 4,299,113 | 11/1981 | Belotti | 72/453.16 |

*Primary Examiner*—Lowell A. Larson

*Attorney, Agent, or Firm*—Dressler, Goldsmith, Shore, Sutker & Milnamow, Ltd.

[57] ABSTRACT

An improved tubing expansion apparatus is disclosed which greatly facilitates convenient expansion of tubing, such as for repair and replacement of motor vehicle exhaust systems. The apparatus includes a hand-holdable expander unit and a separate pressurized fluid supply unit joined in fluid communication with the expander unit by a flexible fluid conduit. In order to provide selective control of the fluid supply unit from the expander unit, a trigger-like electrical switch is provided on the expander unit to permit remote operation of the fluid supply unit. Other features of the apparatus enhance its versatility for conveniently effecting varying degrees of expansion on tubing of different dimensions.

15 Claims, 4 Drawing Figures

10
12
14
16
18
20
22
24
26
28
30
32
34
36
38
40
42
44
46
48
50
52
54
56
58
60
62
70
72
74
76
78
102
2.
2.

TUBING EXPANDER APPARATUS

TECHNICAL FIELD

The present invention relates generally to an apparatus for expanding the end portion of tubing or the like, and more particularly to an expander apparatus including a hand-holdable, fluid-operated expander unit and an associated pressurized fluid supply unit remotely operable from the expander unit.

BACKGROUND OF THE INVENTION

During repair or replacement of exhaust systems for motor vehicles or the like, it is frequently necessary to effect expansion of end portions of tubing to accommodate assembly with associated components. In this manner, a closely fitting, overlapping joint can be formed between adjacent sections of tubing, thereby eliminating the need for separate adapters. The ability to expand tubing in this manner greatly facilitates repair or replacement of exhaust systems. Naturally, expansion of tubing can also facilitate joining of tubular sections in applications apart from exhaust system service.

An apparatus which has proven particularly effective for efficiently expanding tubing is illustrated in U.S. Pat. No. 3,385,087, to Huth. This patent discloses a swaging tool for effecting tubing expansion, which includes a fluid-operated ram operatively connected to an expander, with the expander being adapted to coact with a plurality of jaw segments disposed about the expander. The tool is operated by positioning the jaw segments within the end portion of a piece of tubing, and by stroking the fluid ram so that the jaw segments are urged outwardly to effect expansion of the tubing. Portions of this patent not inconsistent with the present disclosure are herein incorporated by reference.

While the above-described expander tool is effective for expanding tubing as intended, use of the tool can sometimes be inconvenient. In the past, tools of this nature have typically been supplied with pressurized fluid for their operation from a foot-operated fluid supply unit. The fluid supply unit typically comprises a device which is provided with pressurized air, and which utilizes the pressurized air for pressurizing hydraulic fluid which is supplied to the expander unit through a suitable conduit. For example, U.S. Pat. Nos. 4,198,844 and 4,308,736, both to Lowe et al., each illustrate a tube expander device which is described as controlled by an air-oil pump connected to a source of shop air.

As will be appreciated, expansion of tubing during exhaust system service must frequently be effected when the tubing to be expanded is positioned on an automobile or other motor vehicle. Naturally, working space is often limited, and service personnel frequently find it difficult to conveniently actuate a foot-operated fluid supply unit for the expander tool. In some instances, it can be practically impossible to properly operate the fluid supply unit while holding the expander tool in proper position to perform the expansion operation. Of further significance, a suitable source of air is not always available for operation of expander devices which employ an air-oil pump or the like, thus limiting versatility of such arrangements.

Another disadvantage of tubing expander arrangements such as described above relates to the speed with which expansion is effected. With most previous arrangements, a relatively long period of time is required for sufficient fluid pressure to be built up in the expander tool so that the desired degree of expansion is effected (typically on the order of 30 seconds or more). This further detracts from convenient operation, since the expander tool ordinarily must be held in position as it operates, and the frequently cramped working space can make holding the expander tool in position for an extended period difficult.

In order to more efficiently perform tubing expansion operations, it is highly desirable to provide an expansion apparatus which overcomes the disadvantages associated with previously known arrangements. It is particularly desirable to provide an apparatus which can be conveniently operated, which performs the expansion operation relatively quickly, and which is readily adjustable so that a user may easily select the degree of expansion to be effected for tubing of different dimensions. The present invention provides these desirable objectives with an apparatus which is very convenient to use, straightforward in construction, and highly efficient in operation.

SUMMARY OF THE INVENTION

The tubing expansion apparatus embodying the present invention includes a hand-holdable, hydraulic fluid operated expander unit, and a separate, pressurized hydraulic fluid supply unit which is adapted to supply pressurized hydraulic fluid to the expander unit through a flexible hydraulic fluid conduit. In order to promote convenient use, the apparatus includes an arrangement whereby the fluid supply unit can be remotely operated from the expander unit. In this way, a user may easily properly position the expander unit for the expansion operation, and then operate the fluid supply unit from the expander unit to effect expansion. As will be recognized, this eliminates the need for a user to be positioned in close proximity to the fluid supply unit, greatly facilitating convenient use, particularly where work space is limited. Notably, the present apparatus can effect expansion relatively quickly, and includes means so that the apparatus can be readily adapted to effect varying degrees of expansion on tubing of different dimensions. In the preferred embodiment, the fluid supply unit is electrically powered, thus obviating the need for a source of pressurized shop air, and greatly enhancing the versatility of the apparatus.

The expander unit of the present apparatus includes a fluid-operated motor, preferably comprising a single-acting hydraulic fluid ram, which operates a plurality of outwardly movable expansion jaws on the expander unit. The unit includes an expander arbor operatively connected to the fluid-operated ram, with the arbor having an outwardly tapered portion which is adapted to cooperate and coact with the expander jaws, which are mounted on the arbor. Fluid pressurization operates the ram in a first direction, thus correspondingly moving the expander arbor so that the expansion jaws are moved outwardly.

The pressurized fluid supply unit of the present apparatus preferably includes a hydraulic fluid pump which is operated by an electrically powered motor. Pressurized fluid is supplied to the expander unit from the supply unit through suitable flexible hydraulic fluid conduit, which is preferably of sufficient length to permit convenient use of the expander unit apart from the fluid supply unit.

In order to remotely operate the fluid supply unit from the hand-held expander unit, a trigger-like electrical switch is preferably provided on the handle portion of the expander unit. The switch permits the fluid supply unit to be operated from the expander unit for controlling the flow of pressurized fluid. In the preferred embodiment, control of the pressurized fluid supply is provided by a solenoid-operated hydraulic valve which is controlled by the switch mounted on the expander unit. The hydraulic valve is ordinarily in an open position, during which time hydraulic fluid supplied from the hydraulic pump is circulated within the fluid supply unit, and is not supplied to the expander unit. When expansion is to be effected, the user closes the switch mounted on the expander unit, thus causing the solenoid-operated hydraulic valve to close. By this action, the hydraulic fluid conduit joining the fluid supply unit with the expander unit is pressurized, thus delivering pressurized fluid to the hydraulic ram of the expander unit for effecting expansion.

In order to regulate the maximum fluid pressure supplied to the expander unit, the fluid supply unit preferably includes a fluid pressure relief valve associated in fluid communication with the hydraulic fluid pump. After the hydraulic fluid reaches a predetermined maximum pressure (which is ordinarily attained when the fluid ram in the expander unit has been fully stroked and expansion is complete), the relief valve opens to relieve the fluid pressure being applied to the expander unit. In the preferred form, the relief valve audibly opens to signal the user that expansion has been completed.

Other features of the present apparatus facilitate its convenient and efficient use. In the preferred form, the electric motor which drives the hydraulic fluid pump is powered by relatively high voltage current (such as from an alternating current outlet), while in contrast the electrical switch mounted on the hand-held expander unit forms a portion of a relatively low voltage electrical circuit. In this way, the chance of a user experiencing a harmful electric shock is substantially eliminated. Convenient use is further facilitated by the provision of a removable tip portion for the expander arbor of the hand-held expander unit. In this way, varying degrees of expansion can be readily effected by selectively changing the dimension of the outwardly tapering portion of the expansion arbor.

Numerous other advantages and features of the present invention will become readily apparent from the following detailed description of the invention and embodiment thereof, from the claims, and from the accompanying drawings.

DETAILED DESCRIPTION

Figures 1, 2:
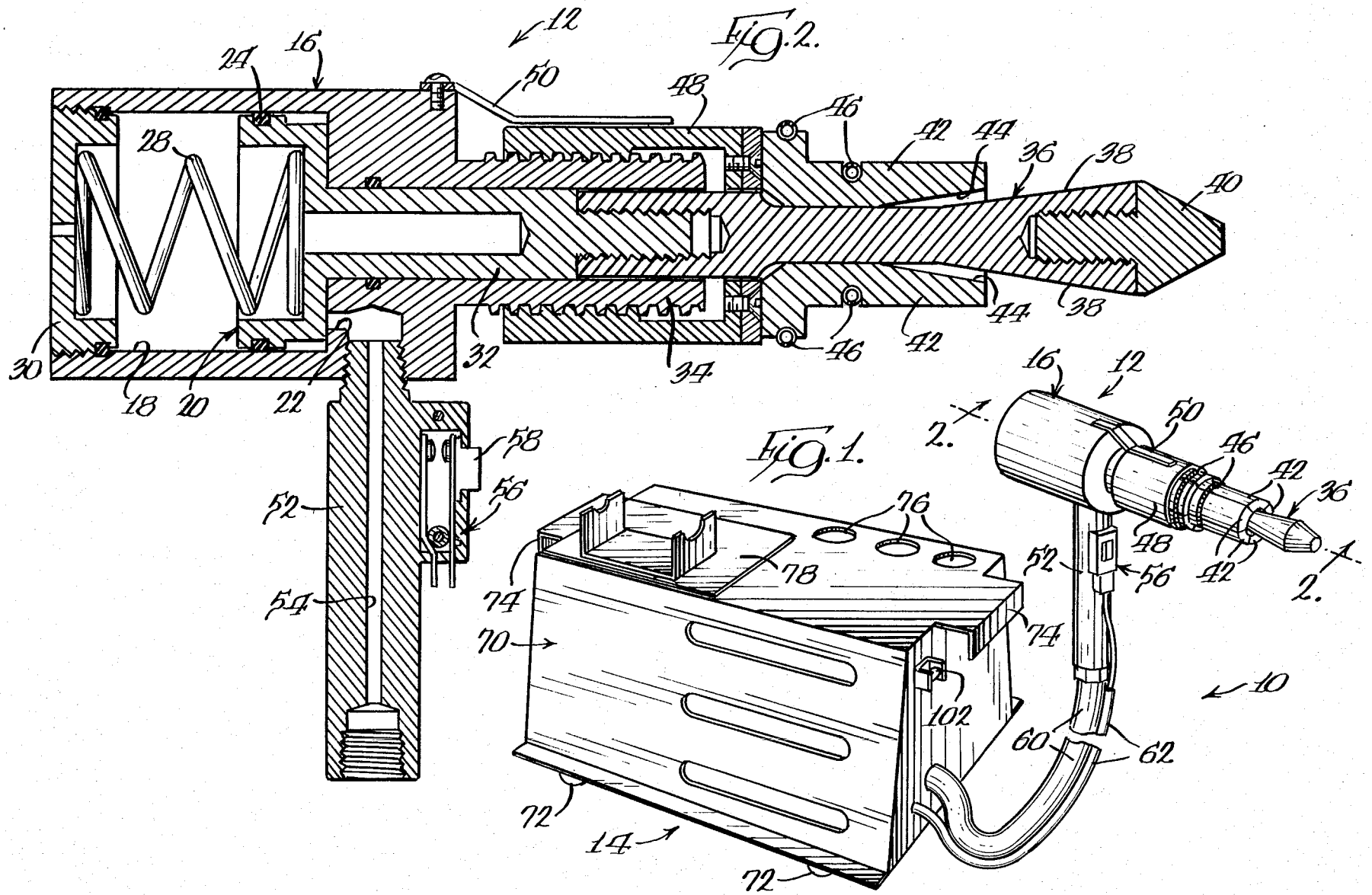
FIG. 1 is a perspective view illustrating the tubing expansion apparatus embodying the present invention, including a hand-holdable expander unit, and a remotely operable pressurized fluid supply unit.
FIG. 2 is a cross-sectional view taken along lines 2—2 of FIG. 1 illustrating the construction of the expander unit illustrated in FIG. 1.

While the present invention is susceptible of embodiment in various forms, there is hereinafter described and illustrated in the drawings a presently preferred embodiment, with the understanding that the present embodiment is to be considered an exemplification of the invention, and is not intended to limit the invention to the specific embodiment shown.

With reference now to FIG. 1, therein is illustrated the tubing expansion apparatus 10 embodying the present invention. As will be recognized by those familiar with the art, devices of this nature operate to swage or deform circular tubing so as to expand or increase the diameter of the tubing a predetermined amount along a finite end portion of the tubing. Tubing expansion of this nature is frequently required during repair or replacement of motor vehicle exhaust systems or the like.

The present expander apparatus includes a hand-holdable expander unit 12, and a separate, remotely operable portable pressurized fluid supply unit 14. As will be further described, expander unit 12 and fluid supply unit 14 are joined in fluid communication with each other by suitable conduit means whereby pressurized fluid is supplied to the expander unit to perform expansion operations. In accordance with the present invention, the fluid supply unit 14 is operable by a trigger-like switch provided on the expander unit 12, thereby greatly facilitating convenient use of the apparatus since the user can easily control the supply of pressurized fluid to the expander unit while appropriately positioning it to perform the desired expansion operation.

With further reference to FIG. 1, and referring more particularly to FIG. 2, the preferred construction of expander unit 12 will be described. The expander unit includes a housing 16 which defines an internal, cylindrical bore 18. A preferably hydraulic fluid piston or ram 20 is disposed and reciprocably movable within housing 16, with fluid piston 20 fitting sealingly within cylindrical bore 18 so that fluid pressurization of the rod end of piston 20 results in it being stroked or moved in a first direction (to the left, referring to the orientation of FIG. 2). To this end, housing 16 defines a hydraulic port 22 which opens against the face of fluid piston 20. Suitable fluid seals 24 and 26 are provided in association with housing 16, and piston 20 and integral piston rod 32, respectively, to assure sealing of the piston as it slides within housing 16.

Because tubing expansion is effected only when fluid piston 20 is stroked in its first direction of movement, the arrangement is preferably single acting. In this regard, a biasing compression coil spring 28 is preferably provided in association with fluid piston 20 within housing 16. Coil spring 28 is held in a captive fashion between fluid piston 20 and a housing end cap 30 which is threaded into the body of the housing. In this way, fluid piston 20 is movable in a second direction opposite to its first, expansion-effecting direction by coil spring 28 when fluid pressure exerted on the piston is relieved. This arrangement is preferred for its reliability of operation and simplicity of construction, and also desirably minimizes the number of hydraulic fluid lines connected to expander unit 12.

Piston rod 32 extends into a threaded shank portion 34 of housing 16. An expansion arbor 36 is operatively connected to piston rod 32, preferably such as by the illustrated threaded connection, so that the arbor moves with piston 20 as it is reciprocably stroked. Arbor 36 includes an outwardly tapering portion which preferably defines a plurality of tapered surfaces 38. Typically, the tapered portion of arbor 36 is either hexagonal, octagonal or cylindrical in cross-section, and thus may include a plurality of distinct tapered surfaces such as 38.

Notably, arbor 36 preferably includes a threadably removable arbor tip portion 40. Replacement of tip portion 40 permits expander unit 12 to be used for effecting expansion of tubing of different sizes. By altering the dimension (specifically the length) of the outwardly tapering portion of arbor 36, expansion of relatively large pieces of tubing can be effected, even though the working stroke of fluid piston 20 (and thus the arbor 36) is essentially fixed. Thus, the provision of removable arbor tip 40 permits the tip portion to be replaced with a tip portion such as 40′ illustrated in FIG. 3 to facilitate selective changing of the dimension of the outwardly tapering portion of the arbor.

The tubing to be expanded is engaged by a plurality of circumferentially spaced, outwardly movable segmented expansion jaws 42. The number of expansion jaws 42 preferably corresponds to the number of distinct tapered surfaces 38 provided on arbor 36, and thus would typically comprise six or eight separate jaw segments, depending upon the configuration of arbor 36. Each expansion jaw 42 includes an inwardly facing, outwardly tapering surface 44 which is adapted to engage and coact with a respective one of surfaces 38 on arbor 36. Thus, movement of arbor 36 in its first direction attendant to fluid pressurization of piston 20 acts to urge jaws 42 outwardly for effecting expansion of tubing fitted about the expansion jaws. The expansion jaws 42 are supported on the arbor 36 for coaction therewith, and are held in position as a group by circumferentially extending coil springs 46. Notably, this preferred construction permits the group of expansion jaws 42 to be easily slipped over the free end of arbor 36 so that variously sized groups of expansion jaws can be fitted on the expander unit. Again, this preferred construction facilitates use of the expander unit for expanding tubing of varying dimensions.

As noted, arbor 36 is movable an essentially fixed distance in its first direction attendant to stroking of fluid piston 20. In order to adjust the degree of outward expanding movement of expansion jaws 42, their spacing relative to housing 16 is adjustable. To this end, a jaw spacing adjuster 48 is threadably fitted to shank portion 34 of housing 16 (preferably by Acme-type threads as illustrated), with the face of adjuster 48 adjacent expansion jaws 42 providing a surface against which the expansion jaws seat as they are urged outwardly by movement of arbor 36.

Figure 3:
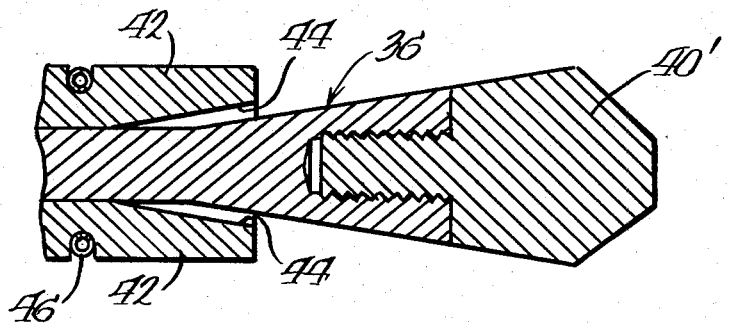
FIG. 3 is a fragmentary, cross-sectional view similar to FIG. 2 illustrating the replaceable arbor tip portion of the expander unit.

Thus, by moving adjuster 48 outwardly with respect to housing 16, and thus relatively increasing the spacing between expansion jaws 42 and housing 16, the degree of outward movement of the expansion jaws attendant to stroking of arbor 36 is relatively increased. Conversely, movement of adjuster 48 toward housing 16 such that the relative spacing between expansion jaws 42 and housing 16 is decreased acts to decrease the amount of outward movement of jaws 42 attendant to movement of arbor 36. In effect, the portion of the stroke of arbor 36 which effects outward expansion of jaws 42 can be selectively varied by selectively altering the position of the jaws 42 relative to housing 16. In a similar regard, replacement of arbor tip portion 40 with a tip portion 40′ such as illustrated in FIG. 3, together with appropriate adjustment of the spacing of jaws 42 relative to housing 16, permits expansion of relatively large tubing to be effected by the jaws 42, without replacement of the expansion jaw assembly or the entire arbor 36. These features of the present invention greatly facilitate its convenient use, and enhance its adaptability for performing expansion of variously dimensioned tubing. Convenient use is further facilitated by the provision of spacing guide 50, which is affixed to housing 16 and generally overlays spacing adjuster 48. Suitable indicia preferably provided on spacing adjuster 48, which can be moved into alignment with spacing guide 50 attendant to rotation of spacing adjuster 48, permit the amount of expansion that will be effected when the unit is operated to be easily determined.

As discussed, tubing expansion is frequently required in areas having limited working space. Thus, it is desirable that expander unit 12 be easily manipulated and held by a user. To this end, the expander unit preferably includes a handle portion 52 connected to the housing 16. This preferred arrangement provides the expander unit 12 with a pistol-like configuration so that the unit can be readily grasped and positioned. In the preferred embodiment, handle portion 52 defines a fluid passage 54 in communication with hydraulic port 22 through which pressurized hydraulic fluid passes to act against fluid piston 20. Fluid passage 54 is joined in fluid communication with fluid supply unit 14 as will be described.

In accordance with the present invention, means associated with expander unit 12 is provided for remotely operating fluid supply unit 14. To this end, an electrical switch 56 is preferably provided on handle portion 52, with switch 56 being selectively closeable by a trigger 58. This feature of the present invention greatly facilitates convenient use of the present tubing expansion apparatus, with the preferred mounting of electrical switch 56 as illustrated facilitating its convenient manipulation while expander unit 12 is grasped by handle portion 52.

Referring again to FIG. 1, expander unit 12 is connected in fluid communication with fluid supply unit 14 by elongated flexible hydraulic conduit 60. Conduit 60 communicates with fluid passage 54 of handle portion 52 of expander unit 12, and thus is in fluid communication with the fluid piston of the expander unit.

Expander unit 12 is further joined to fluid supply unit 14 by electrical wiring 62, which is preferably suitably attached to fluid conduit 60. Electrical wiring 62 electrically joins switch 56 on expander unit 12 with fluid supply unit 14 to permit remote operation of the fluid supply unit by operation of switch 56.

The preferred construction of fluid supply unit 14 will now be described. The fluid supply unit includes a box-like housing 70 which is preferably mounted on dolly wheels 72 for convenient portability of the unit. Handle portions 74 are preferably provided on opposite ends of housing 70 so that the entire fluid supply unit 14 may be easily picked up if desired. Housing 70 preferably defines a plurality of circular openings 76, each of which is adapted to receive a differently sized group of expansion jaw segments such as 42. This facilitates convenient use of the apparatus since differently sized groups of expansion jaws can be kept handy to effect expansion of tubing of different dimensions. As noted above, the expansion jaws of expander unit 12 may be easily replaced merely by slipping the group of expansion jaws over the end of expansion arbor 36.

To further enhance the versatility of use of the present apparatus, housing 70 preferably includes a removable cradle 78 which is removably positionable on the top of the fluid supply unit 14. Cradle 78 is adapted to receive and hold expander unit 12. Cradle 78 provides a convenient and secure storage location for expander unit 12 when the apparatus is not in use, and permits the expander unit to be used while positioned atop housing 70 in cradle 78. Additionally, removable cradle 78 can be easily affixed to a work bench or the like (such as by a suitable clamp) so that expander unit 12 may be positioned thereon for use. This feature further facilitates convenient use of the present apparatus since it is sometimes desirable to effect tubing expansion by grasping the tubing to be expanded while expander unit 12 is held within cradle 78.

Figure 4:
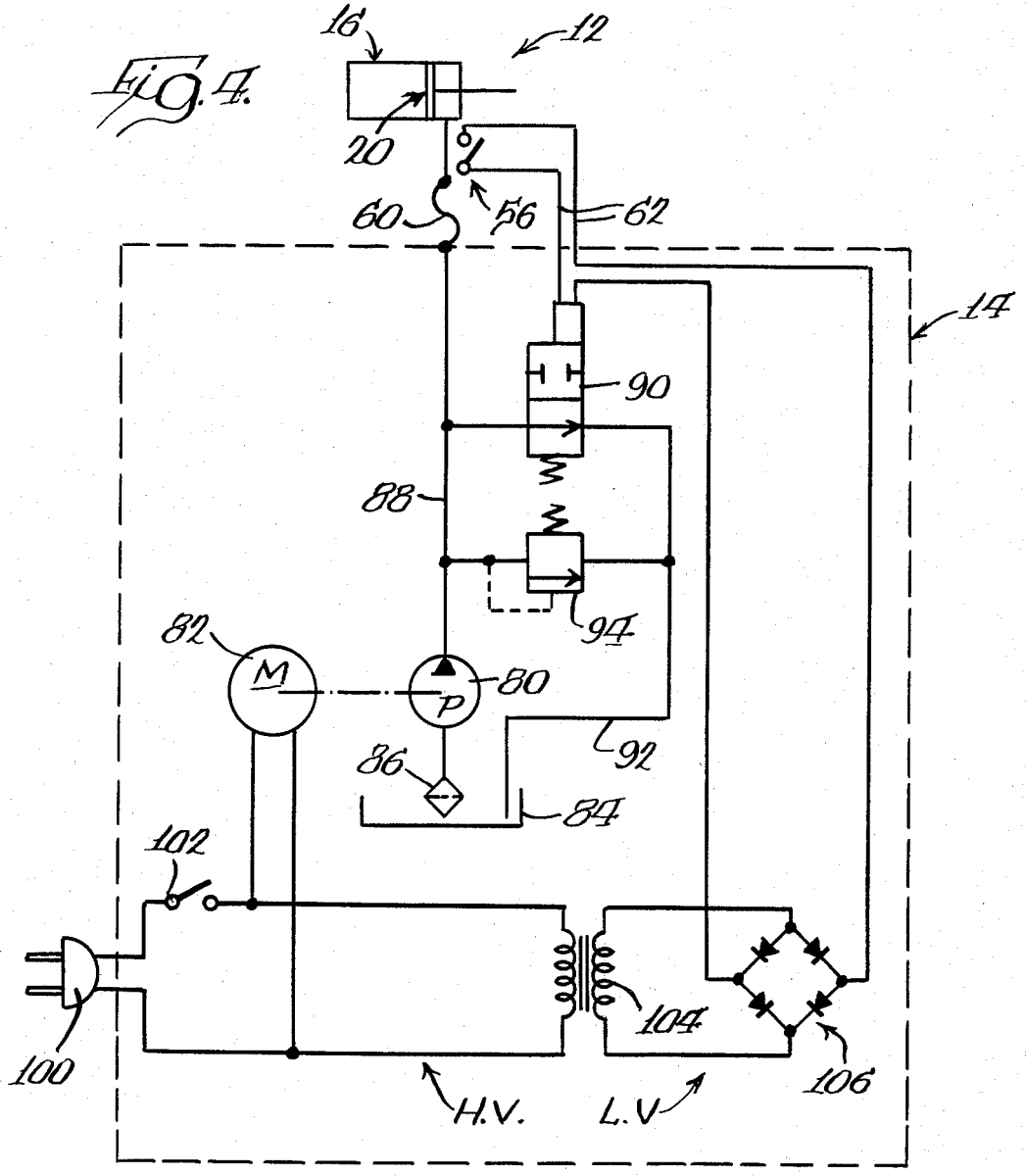
FIG. 4 is a combined hydraulic/electrical schematic diagram of the expansion apparatus embodying the present invention.

Referring now to FIG. 4, a combined hydraulic/electrical schematic diagram is shown illustrating the components of fluid supply unit 14, and their operative interconnection with the hand-held expander unit 12. The fluid supply unit includes an electrically powered hydraulic fluid pump 80, which is driven by an electric motor 82. Pump 80 can be selected according to the expansion requirements of the apparatus. A pump having a flow rate of 0.5 gallons per minute at 1725 revolutions per minute, with a pressure rating of 3400 pounds per square inch (and a maximum rating of 4500 pounds per square inch) has proven suitable. With such a pump, an electric motor 82 rated at ¾ horsepower at 1725 revolutions per minute has been used.

Hydraulic fluid is drawn by pump 80 from a hydraulic fluid reservoir 84 through a suitable filter 86. Pressurized hydraulic fluid is supplied from pump 80 to a fluid conduit 88, which is in communication with fluid piston 20 of expander unit 12 via flexible fluid conduit 60 and fluid passage 54 of the expander unit.

In use of the present apparatus, it is contemplated that pump 80 be run continuously. To this end, a solenoid-operated hydraulic valve 90 is preferably provided for controlling the flow of pressurized hydraulic fluid supplied to expander unit 12. The electrically operated hydraulic valve 90 communicates with pump 80 via conduit 88, and is operable from a first, open position (illustrated in FIG. 4) to a second, closed position attendant to closing of electrical switch 56 on expander unit 12. When hydraulic valve 90 is in its first, open position, pressurized fluid flow from pump 80 is not supplied to expander unit 12, and is instead returned to fluid reservoir 84 via a fluid return conduit 92. To effect expansion, switch 56 is closed, resulting in valve 90 moving to its second, closed position. When this occurs, fluid pressure in conduit 88 immediately increases, thus pressurizing fluid piston 20 of expander unit 12, stroking the fluid piston in its first direction of movement to operate expansion jaws 42.

In the preferred embodiment, a pilot-operated, fluid pressure relief valve 94 is also provided in communication with pump 80 via conduit 88. Relief valve 94 is preferably provided to regulate the maximum fluid pressure which is supplied to expander unit 12 from fluid supply unit 14. When hydraulic valve 90 is in its open position, relief valve 94 is closed. When hydraulic valve 90 is closed attendant to closing of switch 56, relief valve 90 remains closed until a predetermined maximum fluid pressure exists within conduit 88. This predetermined maximum fluid pressure will usually exist in conduit 88 only after fluid piston 20 of expander unit 12 has been fully stroked in its first direction, thus having effected expansion by operation of expansion jaws 42. When the predetermined maximum pressure is reached in conduit 88, relief valve 94 will open to return conduit 92, thus stopping the flow of pressurized fluid to expander unit 12, and permitting the return flow of fluid from the expander unit as spring 28 in the unit urges fluid piston 20 in its second direction of movement to its initial position.

Thus, relief valve 94 functions to automatically stop the flow of pressurized hydraulic fluid to expander unit 12 as soon as the expansion operation is effected. In the event that excessive fluid pressure should build up in conduit 88 even though expansion has not been effected by expander unit 12, relief valve 94 will open, thus preventing damage to the components of the apparatus. In the preferred embodiment of the present apparatus, relief valve 94 opens audibly so that a user of the apparatus receives a signal that the relief valve has opened, and that tubing expansion is completed.

FIG. 4 further illustrates the electrical circuitry provided for operation of the present apparatus. Power is received from a suitable electrical outlet such as through electrical plug 100. A switch 102 is preferably provided such that closing of the switch starts motor 82 to operate pump 80.

As discussed above, it is desirable that electrical power which passes through wiring 62 to switch 56 on expander unit 12 be electrical current of a relatively low voltage. In contrast, electric motor 82 is preferably adapted to be powered by a relatively high voltage electrical current. To this end, the electrical circuitry of the present apparatus preferably includes a high voltage portion (generally designated HV) and a low voltage portion (generally designated LV). A suitable transformer 104 provides an interface between the high voltage and low voltage portions of the electrical circuit, and acts to step down the voltage supplied via electrical plug 100 (such as from 110 volts to 24 volts).

Transformer 104 is wired to a diode bridge 106, which is in turn wired to electrical switch 56 on expander unit 12 via wiring 62, and to hydraulic valve 90. Thus, electrical switch 56 is operatively associated with the solenoid-operated hydraulic valve 90, and forms a portion of an electrical circuit operable by relatively low voltage electrical current for selectively controlling the operation of the hydraulic valve. This desired configuration is straightforward and reliable in construction, and desirably prevents the possibility of harmful electrical shocks to the user of the apparatus.

From the foregoing description of the present apparatus, its operation will be readily apparent. After the appropriate group of expansion jaws 42 is positioned on expansion arbor 36 of expander unit 12, and adjuster 48 rotated to appropriately position the expansion jaws for the desired degree of expansion, switch 102 on fluid supply unit 14 is closed to start motor 82 and drive pump 80. After expansion jaws 42 have been positioned within the tubing to be expanded, switch 56 is closed, thus moving hydraulic valve 90 from its open to its closed position. Fluid pressure in conduit 88 immediately increases, with pressurized fluid thus supplied to the expander unit 12 via conduit 60. Fluid piston 20 is stroked in its first direction of movement, thus effecting outward expanding movement of jaws 42. After piston 20 has been fully stroked, the following increase in fluid pressure in conduit 88 results in relief valve 94 audibly opening. This signals the user to release switch 56, while hydraulic fluid is returned to reservoir 84 via conduit 92. Significantly, the present apparatus has been found to be capable of expanding tubing of sizes commonly used in motor vehicle exhaust systems relatively quickly (usually on the order of only six to eight seconds).

From the foregoing, it will be observed that numerous variations and modifications may be effected without departing from the true spirit and scope of the concept of the present invention. It will be understood that no limitation with respect to the specific apparatus illustrated herein is intended or should be inferred. It is, of course, intended to cover by the appended claims all such modifications as fall within the scope of the claims.

What is claimed is:

1. An apparatus for expanding tubing, comprising:

an expander unit including single-acting fluid-operated motor means, and outwardly movable, expansion jaw means operable by operation of said motor means in a first direction to effect expansion of tubing, said expander unit including biasing means for effecting movement of said motor means in a second direction opposite said first direction;

a pressurized fluid supply unit for providing a source of pressurized fluid;

conduit means joining in fluid communication said expander unit and said fluid supply unit for providing said motor means with pressurized fluid; and electrical switch means associated with said expander unit for remotely operating said fluid supply unit;

said fluid supply unit comprising electrically powered fluid pump means adapted for continuous operation, and solenoid-operated valve means operatively connected with said electrical switch means for controlling the supply of pressurized fluid to said expander unit from said pump means via said conduit means, whereby actuation of said solenoid-operated valve means effects supply of pressurized fluid from said continuously operating pump means to said single-acting motor means of said expander unit for effecting tubing expansion, said biasing means effecting movement of said motor means in said second direction upon completion of tubing expansion.

2. The apparatus for expanding tubing in accordance with claim 1, wherein said electrically powered pump means is adapted to be powered by a relatively high voltage electrical current, said switch means forming a portion of an electrical circuit which is operable by a relatively low voltage electrical current.

3. The apparatus for expanding tubing in accordance with claim 1, wherein said fluid supply unit includes fluid pressure relief means associated with said fluid pump means for regulating the maximum fluid pressure supplied to said expander unit.

4. The apparatus for expanding tubing in accordance with claim 3, wherein said solenoid-operated valve means moves from a first open position to a second closed position upon actuation thereof by said switch means, whereby in said open position fluid from said pump means is returned to a fluid reservoir of said fluid supply unit and pressurized fluid is not supplied to said expander unit, said pressure relief means normally being closed whereby upon movement of said solenoid-operated valve means to said second position pressurized fluid is supplied to said expander unit until a predetermined maximum fluid pressure is created whereupon said pressure relief means opens to relieve the pressure of the fluid in said conduit means.

5. The apparatus for expanding tubing in accordance with claim 1, wherein said fluid motor means comprises a reciprocably operable fluid ram operable in said first direction in response to fluid pressurization thereof for effecting expansion, said expander unit including arbor means operatively connected to said fluid ram and movable therewith in said first direction, said arbor means extending through and supporting said jaw means, and including an outwardly tapered portion adapted to engage and coact with said jaw means when said arbor means is moved in said first direction by said fluid ram for expanding said jaw means to effect expansion of tubing.

6. The apparatus for expanding tubing in accordance with claim 5, wherein said arbor means includes removable tip means to permit replacement of said tip means.

7. The apparatus for expanding tubing in accordance with claim 5, wherein said fluid ram is operable in said second direction by said biasing means comprising coil spring means.

8. The apparatus for expanding tubing in accordance with claim 5, wherein said expander unit includes a housing within which said fluid ram is disposed, said expander unit further including means for adjusting the relative spacing between said jaw means and said housing for adjusting the degree of outward expanding movement of said jaw means.

9. An apparatus for expanding tubing, comprising:

a hand-holdable expander unit, including a housing, a hydraulically operable single-acting fluid ram disposed within said housing, expansion arbor means operatively connected to said fluid ram and movable in a first direction by said fluid ram in response to fluid pressurization thereof, and outwardly movable, expansion jaw means mounted on said arbor means, movement of said arbor means in said first direction effecting outward, expanding movement of said jaw means for expanding tubing, said expander unit including biasing means for moving said fluid ram in a second direction opposite said first direction;

a pressurized fluid supply unit including electric motor means and hydraulic fluid pump means adapted to be continuously driven by said electric motor means, said pump means being adapted to provide a source of pressurized hydraulic fluid;

hydraulic fluid conduit means joining said expander unit and said fluid pump means of said fluid supply unit in fluid communication so that said fluid supply unit is adapted to supply pressurized hydraulic fluid to said fluid ram of said expander unit; and electrical switch means mounted on said expander unit for remotely operating said fluid supply unit to control the supply of pressurized fluid from said fluid supply unit to said expander unit;

said fluid supply unit including solenoid-operated hydraulic valve means in communication with said pump means for controlling the supply of pressurized fluid from said pump means to said fluid ram of said expander unit via said conduit means, said valve means being operable from a first, open position wherein pressurized fluid flow from said pump means is not supplied to said expander unit, to a second, closed position upon actuation thereof by said switch means wherein pressurized fluid is supplied to said expander unit from said continuously driven pump means to effect tubing expansion, said biasing means effecting movement of said fluid ram in said second direction upon completion of tubing expansion.

10. The apparatus for expanding tubing in accordance with claim 9, wherein said electric motor means is adapted to be powered by relatively high voltage power, said electrical switch means forming a portion of relatively low voltage circuit means associated with the power supply for said electrical motor means for controlling the supply of pressurized fluid to said expander unit.

11. The apparatus for expanding tubing in accordance with claim 10, wherein said valve means is operable via said low voltage circuit means by said electrical switch means.

12. The apparatus for expanding tubing in accordance with claim 9, and fluid pressure relief means in communication with said pump means, said relief means opening to relieve fluid pressure in said conduit means when fluid pressure therein reaches a predetermined value attendant to said valve means being in its closed position.

13. The apparatus for expanding tubing in accordance with claim 9, wherein said expander unit includes adjustable spacing means threadably mounted on said housing, said spacing means permitting the relative spacing between said jaw means and said housing to be selectively adjusted for varying the degree of expansion effected by said jaw means attendant to movement of said arbor means in said first direction.

14. The apparatus for expanding tubing in accordance with claim 13, wherein said arbor means includes an outwardly tapered portion adapted to cooperatively engage and coact with said jaw means for effecting expansion thereof, said arbor means further including removable tip means to facilitate selective changing of the dimension of the outwardly tapering portion of said arbor means.

15. The appararus for expanding tubing in accordance with claim 13, wherein said expander unit includes a handle portion connected to said housing, said handle portion defining a fluid passage in communication with said conduit means and said fluid ram for passage of fluid therebetween, said electrical switch means being mounted on said handle portion.

* * * * *